US006178768B1

(12) United States Patent
Djumlija et al.

(10) Patent No.: US 6,178,768 B1
(45) Date of Patent: Jan. 30, 2001

(54) COOLING DEVICE FOR COOLING A HOT, MOVING METAL STRIP

(75) Inventors: Gerlinde Djumlija, Voecklabruck; Jian Chen, Linz; Andreas Schweighofer, Leonding; Johann Oberhumer, Unterweitersdorf, all of (AT)

(73) Assignee: Voest-Alpine Indstrienlagenbau GmbH (AT)

( * ) Notice: Under 35 U.S.C. 154(b), the term of this patent shall be extended for 0 days.

(21) Appl. No.: 09/211,583

(22) Filed: Dec. 14, 1998

(30) Foreign Application Priority Data

Dec. 18, 1997 (AT) ..... 2138/97

(51) Int. Cl.[7] ..... F25D 17/02; B21B 27/06
(52) U.S. Cl. ..... 62/374; 72/201
(58) Field of Search ..... 62/374, 63, 64; 137/625.19; 72/201

(56) References Cited

U.S. PATENT DOCUMENTS

| | | | | |
|---|---|---|---|---|
| 2,319,309 | | 5/1943 | Emigh | 80/35 |
| 3,025,817 | * | 3/1962 | Switch | 113/93 |
| 3,294,107 | * | 12/1966 | Maruszewski et al. | 137/124 |
| 4,497,180 | * | 2/1985 | Graham | 62/63 |
| 4,645,185 | | 2/1987 | Sabatini | 266/114 |
| 4,880,032 | * | 11/1989 | Doutt | 137/625.19 |
| 4,899,547 | * | 2/1990 | Irwin | 62/63 |

FOREIGN PATENT DOCUMENTS

| | | | | |
|---|---|---|---|---|
| 648850 | * | 4/1964 | (BE) | 62/374 |
| 2107664 | | 9/1971 | (DE) . | |
| 3523829 | | 1/1986 | (DE) . | |
| 3704599 | | 8/1988 | (DE) . | |
| 0247021 | | 11/1987 | (EP) . | |
| 51-111411 | | 10/1986 | (JP) . | |
| 2648 | * | 1/1989 | (JP) | 62/374 |
| 910266 | | 3/1982 | (SU) . | |

OTHER PUBLICATIONS

Database WPI, Section Ch, Week 198302 Derwent Publications Ltd., London, GB; Class M21, An 1983–03788K XP002140413 & SU 910 266 A (Magn Metal Wks Des), Mar. 7, 1982.
Patent Abstracts of Japan, vol. 33 (M–638), Nov. 4, 1987 & JP 62 118914 A (Kawasaki Steel Corp), May 30, 1987.
Patent Abstracts of Japan, vol. 1996, No. 10, Oct. 31, 1996 & JP 08 155527 A (NKK Corp), Jun. 18, 1996.
Patent Abstracts of Japan, vol. 005, No. 025 (M–055), Feb. 14, 1981 & JP 55 153615 A (Nippon Steel Corp) Nov. 29, 1980.
Patent Abstracts of Japan, vol. 004, No. 096 (M–020), Jul. 11, 1980 & JP 55 054210 A (IshikaWajima Harima Heavy Ind Co Ltd), Apr. 21, 1980.
Patent Abstracts of Japan, vol. 012, No. 208 (M–709), Jun. 15, 1988 & JP 63 013610 A (Nippon Steel Corp), Jan. 20, 1988.
Patent Abstracts of Japan, vol. 010, No. 368 (M–543), Dec. 9, 1986 & JP 61 162223 A (Mitsubishi Heavy Ind Ltd), Jul. 22, 1986.
Patent Abstracts of Japan, vol. 1995, No 06, Jul. 31, 1995 & JP 07 060331 A (Nippon Steel Corp), Mar. 7, 1995.
International Search Report dated Jun. 29, 2000.

* cited by examiner

*Primary Examiner*—William Doerrler
(74) *Attorney, Agent, or Firm*—Ostrolenk, Faber, Gerb & Soffen, LLP

(57) ABSTRACT

A cooling device for cooling a hot, moving metal strip by means of laminar coolant jets consists of at least one water box (3) located across the direction of strip travel, into which at least one coolant supply line (4) leads and from which a plurality of coolant discharge lines (5) arranged at a distance from one another depart. In order to ensure that uniform flow conditions occur in the coolant jets during operation, particularly also during the starting and stopping phases of the cooling device, and to reliably prevent uncontrolled continued coolant flow, a shut-off device (6) is allocated to each coolant discharge line (5).

13 Claims, 3 Drawing Sheets

COOLING DEVICE FOR COOLING A HOT, MOVING METAL STRIP

Figure 1:
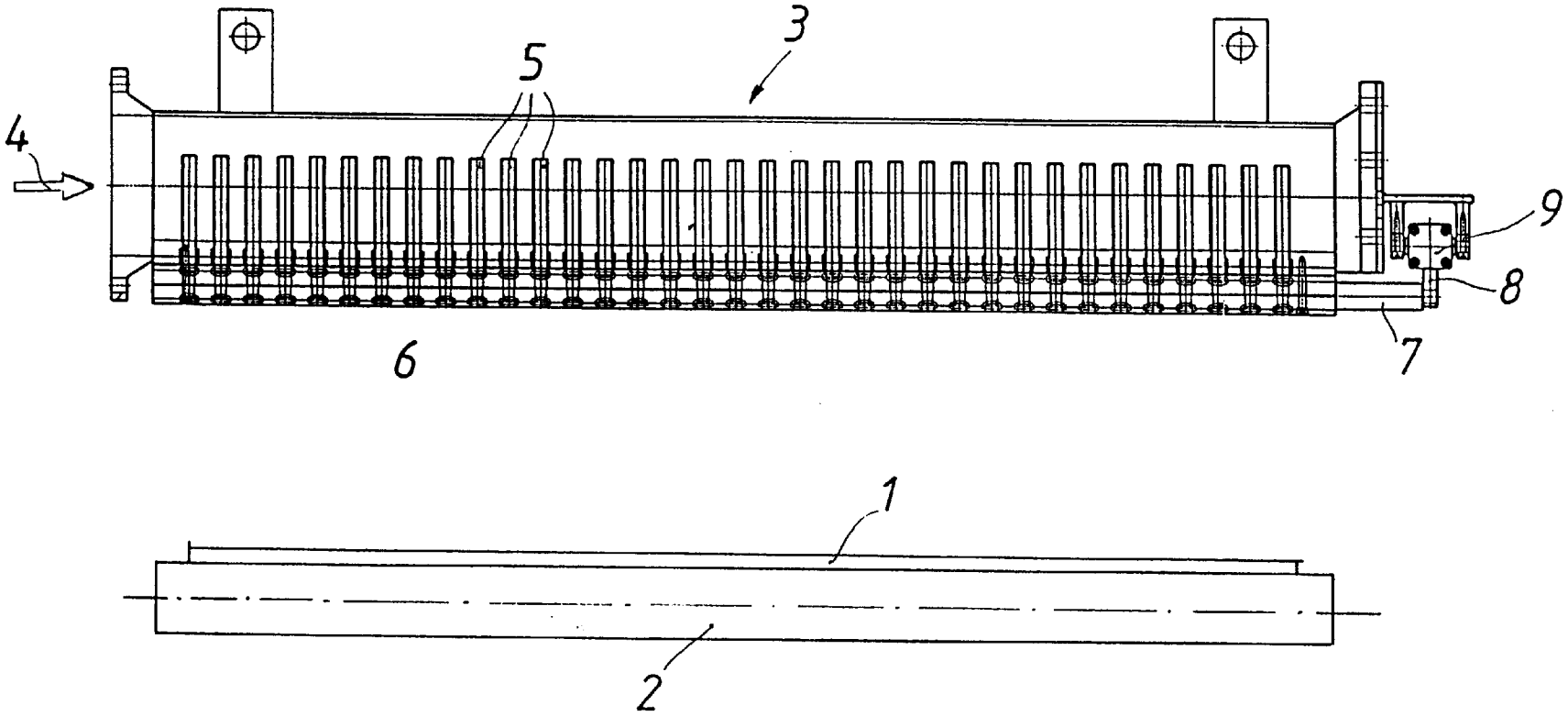

The invention relates to a cooling device for cooling a hot, moving metal strip by means of laminar coolant jets, consisting of at least one water box located across the direction of strip travel, into which at least one coolant supply line leads and from which a plurality of coolant discharge lines arranged at a distance from one another depart.

Cooling of a rolled hot strip in the area of the hot rolling mill, particularly on the runout roller table of a finishing line, is usually implemented in a laminar-flow strip cooling line, wherein the strip is cooled by laminar cooling water jets, the cooling effect being highly dependent on the formation of these cooling water jets. A laminar cooling water jet produces a considerably more intensive cooling action than a turbulent jet because a laminar cooling water jet is capable of breaking through the steam layer forming on the hot strip surface, whereby a higher cooling effect is achieved.

A laminar cooling water line basically consists of several series-connected water boxes extending across the direction of strip travel, each of which is provided with a plurality of cooling water discharge lines. A cooling device of this type is already known from DE-OS 21 07 664, where the cooling water discharge lines are comprised of siphon tubes arranged side by side across the direction of strip travel through which the cooling water is charged onto the strip surface.

When the cooling device is started, it is desirable that a laminar cooling water jet be directly obtained in order to immediately achieve a uniform cooling effect. A turbulent cooling water jet would lead to a reduced and nonreproducible cooling effect after starting. Analogously, a defined situation is required when the cooling device is stopped. Cooling devices of the above-quoted type have the disadvantage that after the cooling device has been stopped considerably large quantities of cooling water continue flowing in a partly entirely irregular manner so that nonreproducible conditions occur again and controllability is very limited.

Accordingly, the technical problem of the invention is to avoid these disadvantages and to propose a cooling device for cooling a hot, moving metal strip by means of laminar coolant jets where not only uniform flow conditions prevail in the coolant jets during operation as well as in the starting and stopping phases of the cooling device but also uncontrolled continued flowing of coolant after stopping the cooling device is reliably prevented.

This problem is solved by allocating a shut-off device to each coolant discharge line on the outlet side. The shut-off device is designed as slide gate or ball valve.

The cooling device is considerably simplified by mechanically coupling several or all shutoff devices allocated to the individual coolant discharge lines and by connecting them with a common adjusting drive.

According to an improvement, the mechanically coupled shut-off devices are comprised of an operating shaft which is provided with ports across the longitudinal axis of the operating shaft at the distance of the coolant discharge lines from one another and which is adjustable by means of an adjusting drive from a position in which the ports are in alignment with the coolant discharge lines into a position in which the operating shaft shuts off the coolant discharge lines and vice versa, wherein the operating shaft is supported in a multipart housing into which the coolant discharge lines lead and annular sealing shells inserted in the housing shells are arranged in the area of the operating shaft which is interspersed with ports, which sealing shells are provided with openings that are in alignment with the coolant discharge lines and with the ports which the operating shaft is interspersed with.

The flow conditions can be further stabilized by allocating a diffusor to each coolant discharge line that serves to focus the coolant jet, the shut-off device being connected downstream of the diffusor and the diameter of the port being larger than the diameter of the outlet in the diffusor.

According to another improvement, the coolant discharge lines are designed as downpipes projecting upwards essentially vertically in the water box, which offer advantages with regard to manufacturing engineering compared with the U-pipes known from DE-OS 21 07 664 and thus substantially reduce the costs of the cooling device.

Altogether, a considerably more compact assembly is obtained where the risk of damage resulting from ascending or sticking strip is considerably reduced.

Moreover, the flow conditions are improved by installing a flow stabilizer in each coolant discharge line. This flow stabilizer is comprised of at least one insert which preferably consists of two flow dividers, preferably plates, which are positioned at right angles to one another, which are inserted in the coolant discharge line and which divide the crosssectional area of the coolant discharge line into segments.

Figure 2:
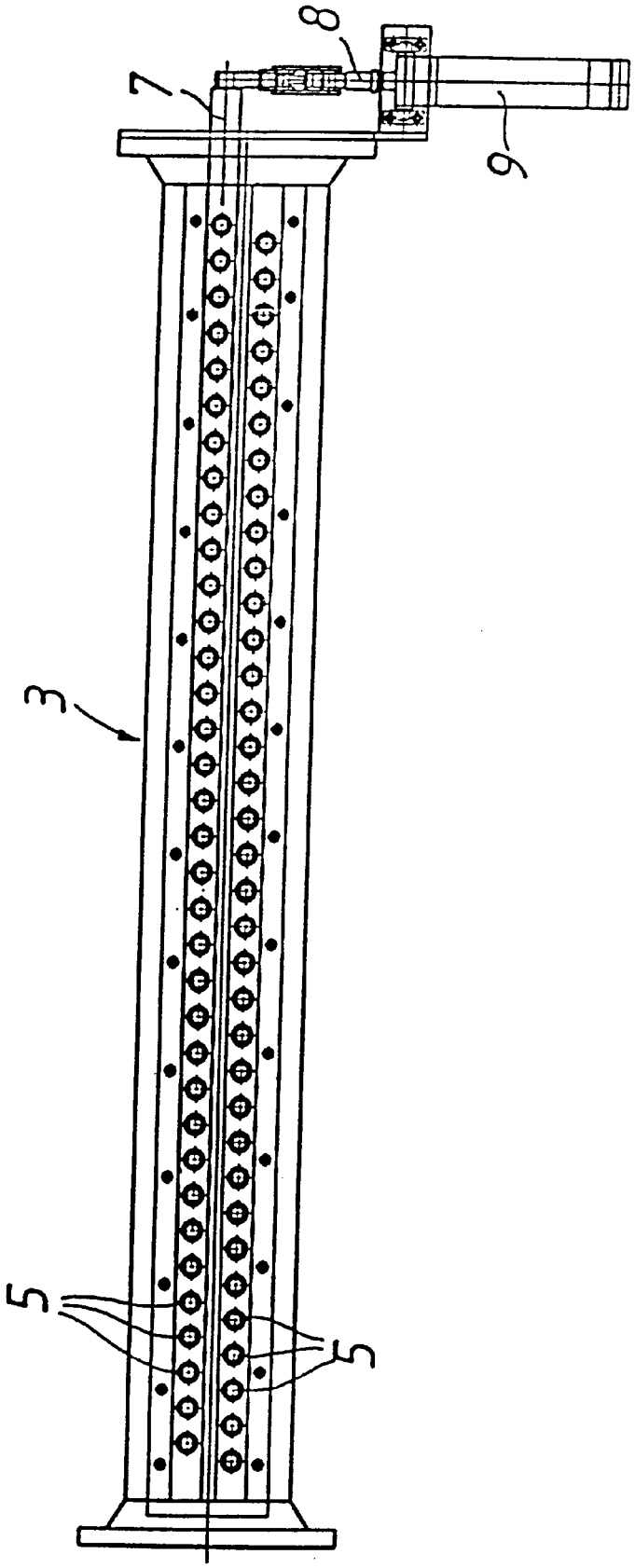
Figure 3:
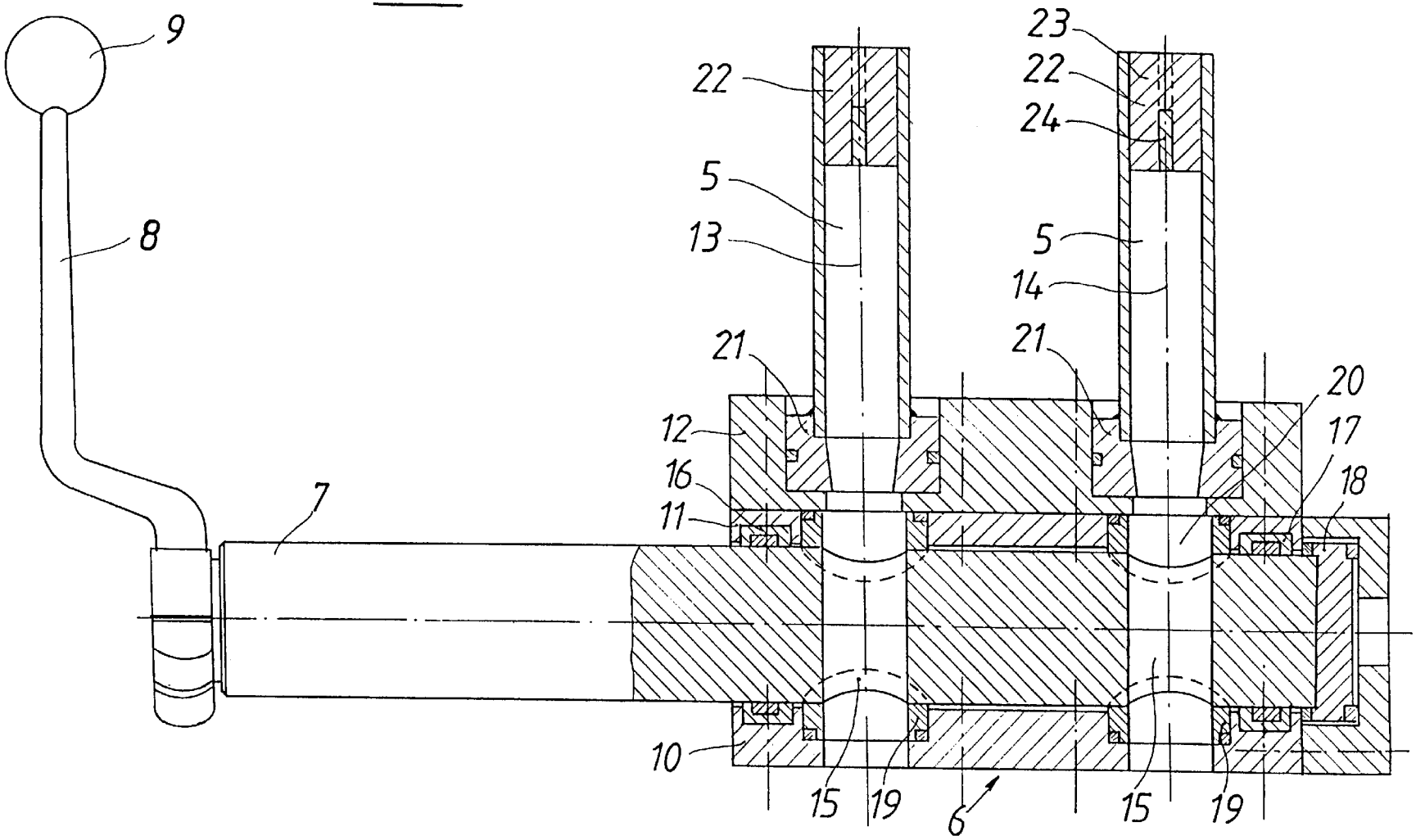

Further advantages and features of this invention result from the following description of a nonlimiting embodiment, referring to the enclosed figures which display the following:

FIG. 1 Longitudinal section through a cooling device according to the invention for cooling a metal strip FIG. 2 Cross section through a cooling device according to the invention for cooling a metal strip FIG. 3 Cross section through the shut-off device FIG. 1 displays a feasible embodiment of the cooling device according to the invention for cooling moving, hot metal strip 1 by means of laminar coolant jets. Purified and possibly treated water is used as coolant. Hot metal strip 1 is withdrawn from a rolling mill not represented or from a an individual mill stand on a transfer roller table indicated by roller table roller 2 and conveyed at a preselected transfer speed at a distance beneath the cooling device. The cooling device consists of several water boxes 3 which are seriesconnected in the direction of strip travel, one of which is represented in FIG. 1 and FIG. 2. Water box 3 is equipped with central coolant supply line 4 and a plurality of coolant discharge lines 5 which are arranged in two rows (FIG. 2), designed as downpipes and project vertically upwards within water box 3. On the outlet side, shut-off devices 6 are connected downstream of coolant discharge lines 5, by means of which coolant discharge from all coolant discharge lines 5 can be simultaneously interrupted or started. Nearly any type of shut-off device can be selected, but it is to be taken into account as a restrictive factor that the coolant jet exiting shut-off device 6 must show a laminar flow pattern. For example, shut-off devices 6 may be designed as slide gates or ball valves.

In FIG. 1 and FIG. 2, shut-off devices 6 are coupled by means of common operating shaft 7 which is connected to common adjusting drive 9 through linkage 8.

FIG. 3 shows shut-off device 6 connected by means of continuous operating shaft 7 and multipart housing 10, 11, 12 to form a single compact component in detail. Operating shaft 7 is interspersed with ports 15 at the distance of center lines 13, 14 of coolant discharge lines 5, which are in alignment with coolant discharge lines 5 in the open position of operating shaft 7. By means of adjusting drive 9, operating shaft 7 can be rotated into a closed position with a 90° horizontal swing which shuts off the coolant flow. Operating shaft 7 is pivoted in a bipartite housing comprised of two housing shells 10, 11 through radial bearings 16, 17 and is fixed in its position relative to coolant discharge lines 5 by means of thrust bearing 18. In the area of ports 15 which operating shaft 7 is interspersed with, annular sealing shells 19 inserted in housing shells and encompassing operating shaft 7 are inserted, which are provided with openings 20 which are in alignment with coolant discharge lines 5 and ports 15 of operating shaft 7. Coolant discharge lines 5 lead into housing 12, wherein diffusor 21 inserted to seal and serving to focus the coolant jets is allocated to each coolant discharge line 5. The clear width of the opening decreases linear in the direction of flow in diffusor 21 and subsequently erratically increases in shut-off device 6 so that the diameter of port 15 is larger than the diameter of the passage duct in diffusor 21.

In order to stabilize the flow, flow stabilizer 22 is installed in each coolant discharge line 5 which is comprised of two flow dividers 23, 24, preferably plates, positioned at right angles and cross-shaped to one another, through which the open cross-sectional area of the coolant discharge line is divided into four segments of equal size over a limited distance.

What is claimed is:

1. Cooling device for cooling a hot, moving metal strip (1) by means of laminar coolant jets, consisting of at least one water box (3) located across the direction of strip travel, into which at least one coolant supply line (4) leads and from which a plurality of coolant discharge lines (5) arranged at a distance from one another depart, characterized in that one shut-off device (6) is allocated to each coolant discharge line (5) on the outlet side and a diffusor (21) for focusing each of the coolant jets is additionally allocated to each coolant discharge line (5), the shut-off device (6) being connected downstream of the diffusor (21) and the diameter of the port (15) being larger than the diameter of the outlet in the diffusor (21).

2. Cooling device according to claim 1, characterized in that the shut-off device (6) is designed as slide gate.

3. Cooling device according to claim 1, characterized in that the shut-off device (6) is designed as ball valve.

4. Cooling device as claimed in claim 1, characterized in that several or all shut-off devices (6) allocated to the individual coolant discharge lines (5) are mechanically coupled and connected with a common adjusting drive (9).

5. Cooling device according to claim 4, characterized in that the mechanically coupled shut-off devices (6) are comprised of an operating shaft (7) which is provided with ports (15) across the longitudinal axis of the operating shaft (7) at the distance of the coolant discharge lines (5) from one another and which is adjustable by means of an adjusting drive (9) from a position in which the ports (15) are in alignment with the coolant discharge lines (5) into a position in which the operating shaft (7) shuts off the coolant discharge lines (5) and vice versa.

6. Cooling device according to claim 5, characterized in that the operating shaft (7) is supported in a multipart housing (10, 11) into which the coolant discharge lines (5) lead and that annular sealing shells (19) inserted in the housing shells are located in the area of the operating lever (7) which is interspersed with ports (15), which sealing shells (19) are provided with openings (20) which are in alignment with the coolant discharge lines (5) and with the ports (15) which the operating shaft (7) is interspersed with.

7. Cooling device for cooling a hot, moving metal strip (1) by means of laminar coolant jets, consisting of at least one water box (3) located across the direction of strip travel, into which at least one coolant supply line (4) leads and from which a plurality of coolant discharge lines (5) arranged at a distance from one another depart, characterized in that one shut-off device (6) is allocated to each coolant discharge line (5) on the outside side and a flow stabilizer (22) is installed in each coolant discharge line (5).

8. Cooling device according to claim 7, characterized in that the flow stabilizer (22) is comprised of at least one insert which is preferably composed of two flow dividers (23, 24), preferably plates, which are positioned at right angles to one another, which are inserted in the coolant discharge line and which divide the cross-sectional area of the coolant discharge line into segments.

9. Cooling device according to claim 7, characterized in that the shut-off device (6) is designed as slide gate.

10. Cooling device according to claim 7, characterized in that the shut-off device (6) is designed as ball valve.

11. Cooling device as claimed in claim 10, characterized in that several or all shut-off devices (6) allocated to the individual coolant discharge lines (5) are mechanically coupled and connected with a common adjusting drive (9).

12. Cooling device according to claim 11, characterized in that the mechanically coupled shut-off devices (6) are comprised of an operating shaft (7) which is provided with ports (15) across the longitudinal axis of the operating shaft (7) at the distance of the coolant discharge lines (5) from one another and which is adjustable by means of an adjusting drive (9) from a position in which the ports (15) are in alignment with the coolant discharge lines (5) into a position in which the operating shaft (7) shuts off the coolant discharge lines (5) and vice versa.

13. Cooling device according to claim 12, characterized in that the operating shaft (7) is supported in a multipart housing (10, 11) into which the coolant discharge lines (5) lead and that annular sealing shells (19) inserted in the housing shells are located in the area of the operating lever (7) which is interspersed with ports (15), which sealing shells (19) are provided with opening (20) which are in alignment with the coolant discharge lines (5) and with the ports (15) which the operating shaft (7) is interspersed with.

* * * * *